US006945302B2

(12) United States Patent
Nien

(10) Patent No.: US 6,945,302 B2
(45) Date of Patent: Sep. 20, 2005

(54) WINDOW BLIND CONTROL STRUCTURE

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 78 days.

(21) Appl. No.: 10/642,190

(22) Filed: Aug. 18, 2003

(65) Prior Publication Data

US 2004/0261956 A1 Dec. 30, 2004

(30) Foreign Application Priority Data

Jun. 27, 2003 (TW) ..... 92211875 U

(51) Int. Cl.[7] ..... E06B 9/30
(52) U.S. Cl. ..... 160/170; 160/176.1 R
(58) Field of Search ..... 160/170, 168.1 R, 160/173 R, 172 R, 176.1 R, 177 R, 178.1 R, 168.1 P, 176.1 P

(56) References Cited

U.S. PATENT DOCUMENTS 4,122,885 A * 10/1978 Marotto ..... 160/176.1 R
4,200,135 A * 4/1980 Hennequin ..... 160/168.1 R
5,228,491 A * 7/1993 Rude et al. ..... 160/171
5,396,945 A * 3/1995 Meyer ..... 160/177 R
5,603,371 A * 2/1997 Gregg ..... 160/176.1 P
5,628,356 A * 5/1997 Marocco ..... 160/170
5,671,793 A * 9/1997 Lee ..... 160/168.1 R
5,906,232 A * 5/1999 Bauer et al. ..... 160/170
6,619,365 B1 * 9/2003 Wen et al. ..... 160/168.1 P
6,644,376 B2 * 11/2003 Wielen ..... 160/176.1 R
6,655,441 B2 * 12/2003 Wen et al. ..... 160/168.1 P
6,659,156 B2 * 12/2003 Wen et al. ..... 160/168.1 P

FOREIGN PATENT DOCUMENTS

FR 2 692 002 12/1993

* cited by examiner

*Primary Examiner*—David Purol
(74) *Attorney, Agent, or Firm*—Browdy and Neimark, PLLC

(57) ABSTRACT

A window blind control structure used in a window blind for controlling lifting and tilting of the blind slats is constructed to include a transmission mechanism mounted in a headrail of the window blind and coupled to blind slats of the window blind, a linking mechanism coupled to the transmission mechanism, and an operation device for operation by the user to bias the linking mechanism and to further drive the transmission mechanism to adjust the elevation and tilting angle of the blind slats.

23 Claims, 11 Drawing Sheets

WINDOW BLIND CONTROL STRUCTURE

BACKGROUND OF THE INVENTION

1. Field of the Invention

The present invention relates generally to a window blind and, more specifically, to a window blind control structure for use in a window blind to control the elevation and tilting angle of the blind slats.

2. Description of the Related Art

A conventional window blind is generally comprised of a headrail fixedly located on the top side of the window, and a blind body suspended from the headrail and controllable by an external force to change its window shading status.

Conventional window blinds may have the lift cord and tilt cord exposed to the outside or arranged in a hidden status. A window blind with exposed lift cord and tilt cord has the lift cord and the tilt cord respectively suspended from the left and right ends of the headrail for pulling by the user to adjust the elevation or tilting angle of the blind slats. Because the lift cord and the tilt cord are exposed to the outside and accessible to children, an accident may happen when a child playing with the lift cord or tilt cord for fun.

Various window blinds with hidden cord members have been disclosed, and have appeared on the market. There is known a window blind with hidden cord members which uses spring means to keep the blind slats in balance and to hold the blind slats and the bottom rail in position after an adjustment of the window blind by the user. There is known another design of window blind with hidden cord members, which uses the tension force of a positioning cord member to support the bottom rail in position after an adjustment of the window blind by the user. The use of spring means of positioning cord member cannot eliminate the problem of elastic fatigue. When the problem of elastic fatigue occurred, the spring means or positioning cord member can no longer support the bottom rail accurately in position. There is also known a window blind, which uses an operation rod and a linking mechanism to substitute for a lift cord for blind slats lifting control. A similar design is shown in French Patent Publication No.2692002. This window blind design eliminates the drawbacks of the aforesaid conventional window blinds with hidden cord members. However, this design is used for controlling the elevation of the blind slats only. It cannot control the tilting angle of the blind slats. For controlling the tilting angle of the blind slats, an additional tilting rod and tilting transmission mechanism should be provided. The arrangement of the additional tilting rod and tilting transmission mechanism greatly complicates the structure of the window blind. Because lifting and tilting of the blind slats are separately controlled, the operation is inconvenient.

SUMMARY OF THE INVENTION

The present invention has been accomplished under the circumstances in view. It is the main object of the present invention to provide a window blind control structure, which has no cord member exposed to the outside, preventing hanging of exposed cord member on a child accidentally.

It is another object of the present invention to provide a window blind control structure, which uses one single driving source to control lifting and tilting of the blind slats.

To achieve these objects of the present invention, the window blind control structure is installed in a window blind having a headrail and a window body formed of a bottom rail and a set of slats and suspended from the headrail. The window blind control structure comprises a transmission mechanism mounted in the headrail of the window blind. The transmission mechanism has an amplitude modulation control device coupled to the blind body for controlling lifting of the blind body, a frequency modulation control device coupled to the blind body for controlling tilting of the blind body, and a clutch coupled to the amplitude modulation control device and the frequency modulation control device for controlling synchronous action between said amplitude modulation control device and said frequency modulation control device. A linking mechanism is mounted in the headrail and coupled to the transmission mechanism, having an input member adapted to receive an external biasing force, and an actuating member coupled between the input member and the transmission mechanism and adapted to drive the transmission mechanism upon action of the input member. An operation device is coupled to the input member of the linking mechanism for operation by the user to rotate the input member.

DETAILED DESCRIPTION OF THE INVENTION

Figure 1:
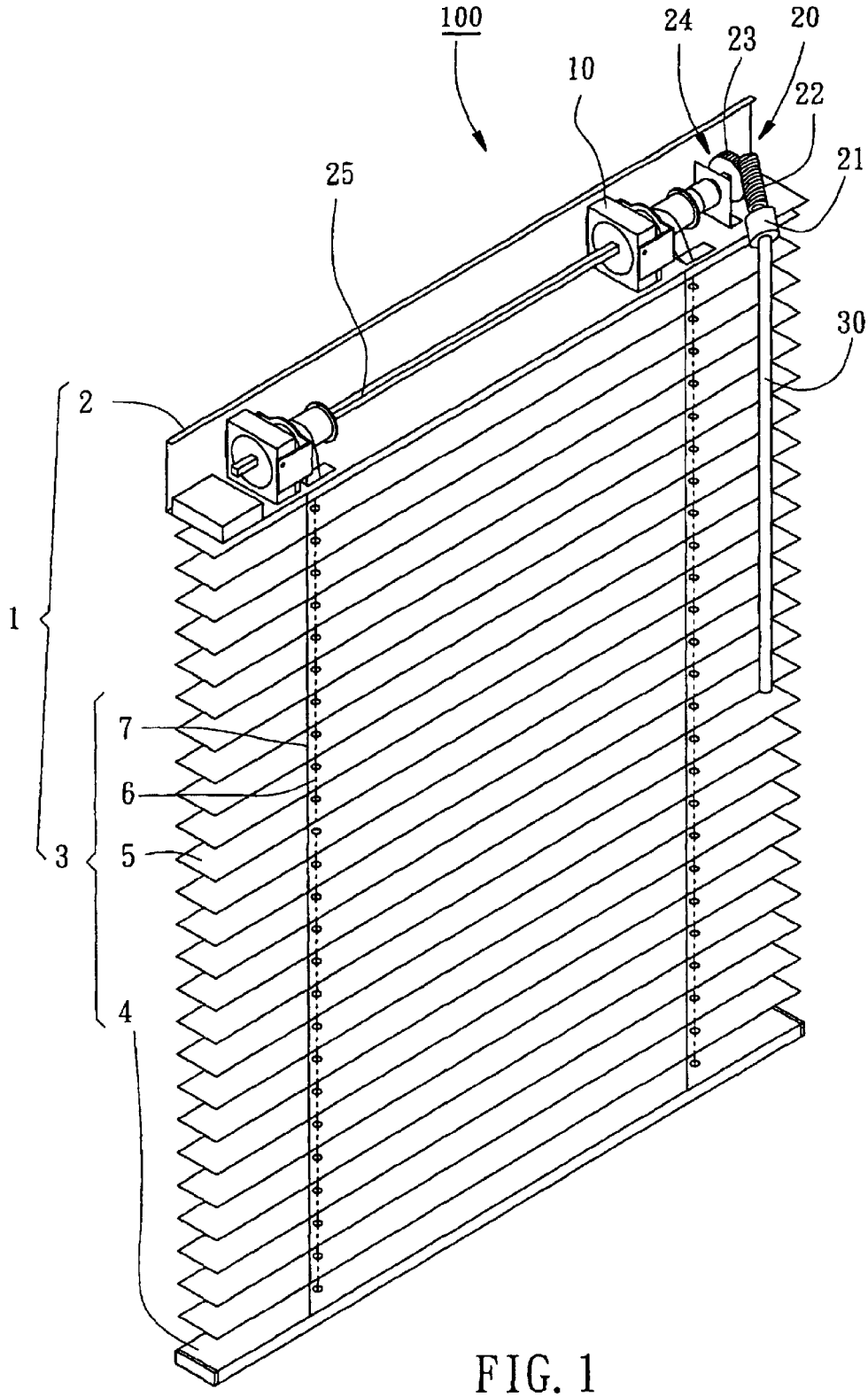
FIG. 1 illustrates a window blind control structure installed in a window blind according to a first preferred embodiment of the present invention.

Referring to FIG. 1, a window blind control structure 100 is used in a window blind 1. The window blind 1 comprises a headrail 2, and a blind body 3. The headrail 2 is transversely (horizontally) affixed to the top side of the window (not shown). The blind body 3 comprising a bottom rail 4 suspended below the headrail 2, a set of slats 5 transversely (horizontally) arranged in parallel between the headrail 2 and the bottom rail 4, two lift cords 6 bilaterally longitudinally (vertically) extended through the slats 5, and two ladder tapes 7 bilaterally longitudinally extended over the slats 5 and the bottom rail 4 to join the slats 5 and the bottom rail 4. Each lift cord 6 has a bottom end affixed to the bottom rail 4 and a top end extended to the inside of the headrail 2. Each ladder tape 7 has two distal ends extended to the inside of the headrail 2. The lift cords 6 are adapted to control the elevation of the bottom rail 4. The ladder tapes 7 are adapted to control the tilting angle of the slats 5.

Referring to FIG. 1 again, the control structure 100 comprises a transmission mechanism 10 mounted in the headrail 2 of the window blind 1, a linking mechanism 20 mounted in the headrail 2 and coupled to the transmission mechanism 10, and an operation device 30 coupled to the linking mechanism 20 for operation by the user.

Referring to FIG. 1 again, the linking mechanism 20 comprises a rod-like input member 21 rotatably and substantially vertically pivoted to the right end inside the headrail 2 of the window blind 1 and partially extended out of the bottom side of the headrail 2, a double-thread worm 22 fixedly connected to the top side of the input member 21, an actuating member 24 formed of a worm gear 23 and meshed with the double-thread worm 22, and a rod member 25 of non-circular cross-section axially extended from the center of the worm gear 23 for synchronous rotation with the worm gear 23 and horizontally suspended inside the headrail 2 in parallel to the slats 5.

Figure 2:
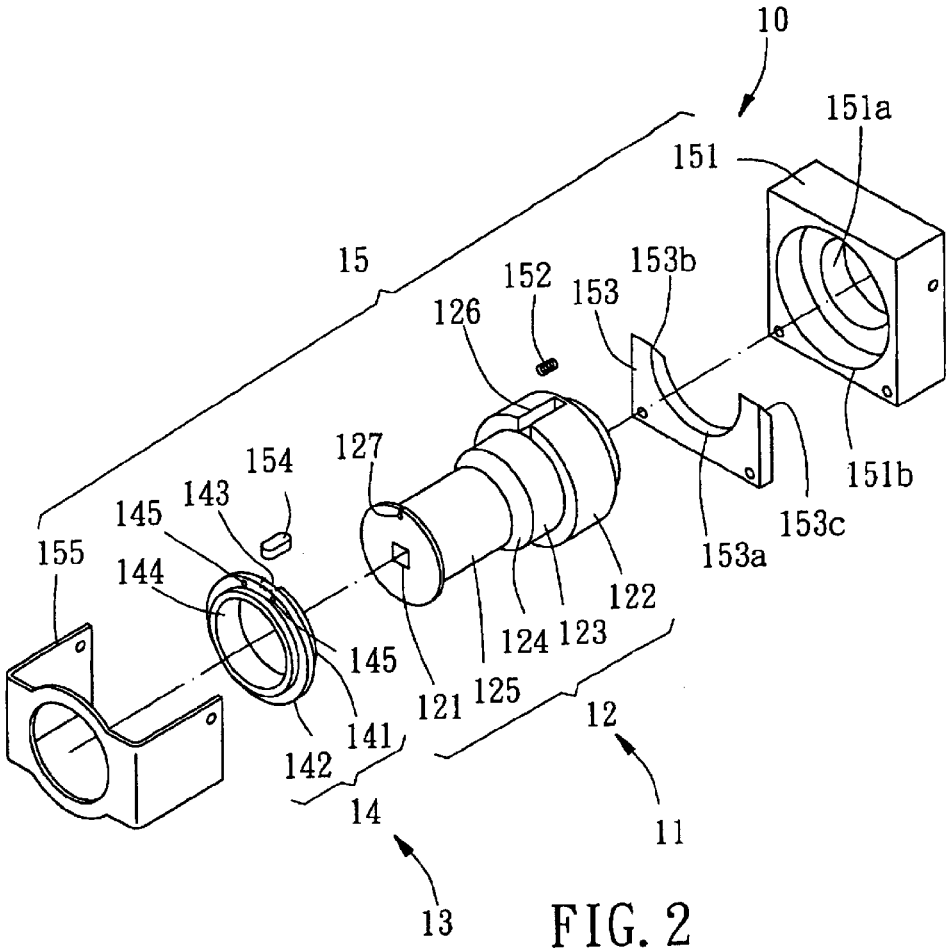
FIG. 2 is an exploded view of one symmetrical half of the transmission mechanism of the window blind control structure according to the first preferred embodiment of the present invention.
Figure 3:
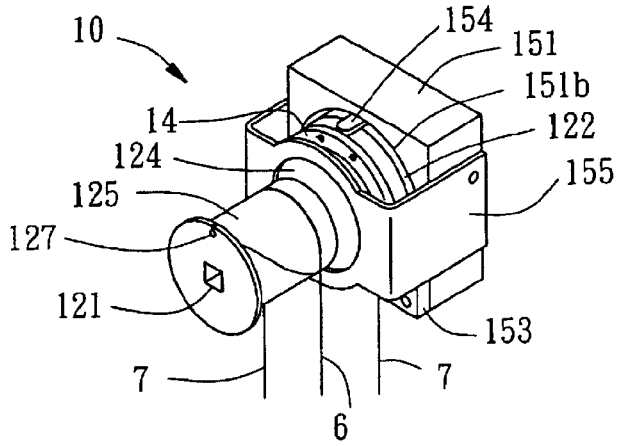
FIG. 3 is an assembly view of FIG. 2.
Figure 4:
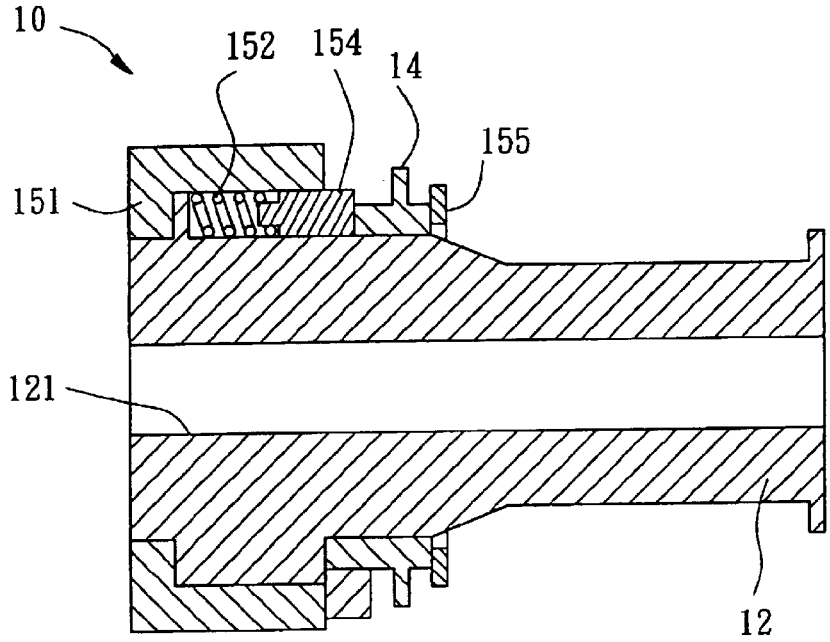
FIG. 4 is a sectional view in an enlarged scale of a part of FIG. 1, showing the structure of the transmission mechanism.

Referring to FIGS. 2 and 3 and FIG. 1 again, the transmission mechanism 10 comprises two amplitude (lift cord) modulation control devices 11, two frequency (ladder tape) modulation control devices 13, and two clutches 15. The amplitude modulation control devices 11, the frequency modulation control devices 13, and the clutches 15 are respectively bilaterally mounted inside the headrail 2 corresponding to the lift cords 6 and the ladder tapes 7.

Each amplitude (lift cord) modulation control device 11 comprises an amplitude control wheel 12. The amplitude control wheel 12 is a stepped cylindrical member, having a head 122 disposed at one end, a tail 125 disposed at the other end, a body 123 axially disposed between the head 122 and the tail 125, the body 123 having an outer diameter smaller than the head 122 but greater than the tail 125, a conical portion 124 connected between the body 123 and the tail 125 corresponding to one lift cord 6 and sloping in direction from the body 123 toward the tail 125, an axial center through hole 121 of non-circular cross-section axially extended through the center of the head 122, the body 123, the conical portion 124 and the tail 125 and adapted to receive the rod member 25 for synchronous rotation with the rod member 25, a longitudinal slot 126 axially extended from the body 123 into the head 122, and a retaining portion 127 located on the free end of the tail 125 for the connection of the top end of one lift cord 6 (see FIG. 3).

Each frequency (ladder tape) modulation control device 13 comprises a frequency control wheel 14. The frequency control wheel 14 comprises a body 141, a head 142 connected to one end of the body 141, a groove 143 inwardly extended from the free end of the body 141, a circular through hole 144 axially extended through the body 141 and the head 142. By means of the circular through hole 144, the frequency control wheel 14 is sleeved onto the body 123 of the amplitude control wheel 12, keeping the body 141 of the frequency control wheel 14 abutted against the head 122 of the amplitude control wheel 12. The two ends of the ladder tapes 7 are respectively fastened to respective retaining portions 145 at the heads 142 of the frequency control wheels 14 of the corresponding frequency (ladder tape) modulation control device 13 (see FIGS. 2 and 3).

Each clutch 15 is comprised of a holder base 151, a spring member 152, a stop block 153, a link 154, and a limiter 155. The holder base 151 is fixedly mounted in the headrail 2, having a circular center through hole 151*a* and a circular recessed hole 151*b* in one side around the center through hole 151*a*. The diameter of the circular center through hole 151*a* is smaller than the outer diameter of the head 122 of the amplitude control wheel 12. The diameter of the circular recessed hole 151*b* is not less than the outer diameter of the head 122 of the amplitude control wheel 12 so that the head 122 of the amplitude control wheel 12 can be inserted into the circular recessed hole 151*b* and stopped outside the circular center through hole 151*a*. The spring member 152 is mounted in the slot 126 of the amplitude control wheel 12, and stopped at inner end of the slot 126. The stop block 153 is affixed to the corresponding holder base 151 adjacent to the circular recessed hole 151*b*, having a smoothly arched notch 153*a* fitting the periphery of the circular recessed hole 151*b*, and two sloping faces 153*b* and 153*c* respectively downwardly extended from the top at two sides of the smoothly arched notch 153*a* toward the circular recessed hole 151*b* of the corresponding holder base 151. The link 154 is mounted in the slot 126 of the amplitude control wheel 12 and supported on the other end of the spring member 152. The spring member 152 imparts an outward pressure to the link 154, thereby causing the link 154 to engage into the groove 143 of the frequency control wheel 14. Normally, the link 154 has one part engaged into the slot 126 and the other part engaged into the groove 143, for enabling the frequency control wheel 14 to be rotated with the amplitude control wheel 12 synchronously. The limiter 155 is mounted on the holder base 151 for preventing escape of the frequency control wheel 14 from the amplitude control wheel 12.

The operation device 30 is a rod member downwardly extended from the input member 21 to a certain distance for operation by the user. The operation device 30 may be formed integral with the bottom side of the input member 21. Alternatively, the operation device 30 can be made having a coupling device at the top for coupling to a matching coupling device at the bottom side of the input member.

After detailed description of the structure and relative positioning of the parts of the control structure 100, the operation of the present invention is outlined hereinafter.

Figure 5:
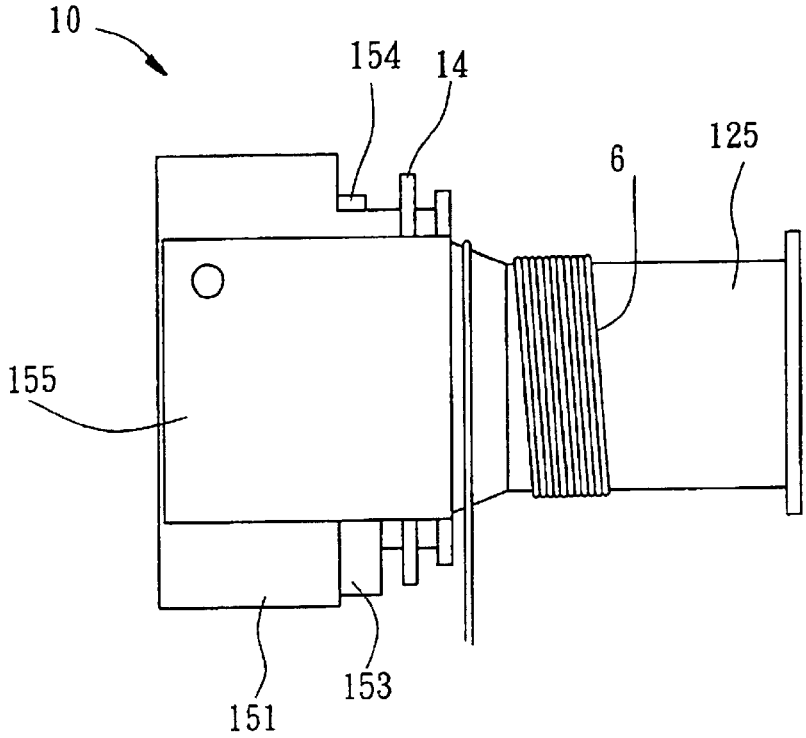
FIG. 5 is a schematic plain view in an enlarged scale of a part of FIG. 1, showing the lift cord wound round the tail of the corresponding amplitude control wheel.

With Respect to amplitude control (lifting control):

When receiving the slats 5, rotate the operation device 30 with the hand to drive the input member 21 to rotate the double-thread worm 22, the worm gear 23 and the rod member 25 in one direction, thereby causing the amplitude control wheels 12 of the amplitude (lift cord) modulation control devices 11 of the transmission mechanism 10 to roll up the lift cords 6 (see FIG. 5). When rotating the amplitude control wheels 12 to roll up the lift cords 6, the lift cords 6 are wound round the conical portions 124 of the respective amplitude control wheels 12, and then extended around the periphery of the tails 125 of the respective amplitude control wheels 12 smoothly in a good order, and therefore the bottom rail 4 is lifted and the slats 5 are received with the lifting bottom rail 4 to the desired elevation.

Figure 6:
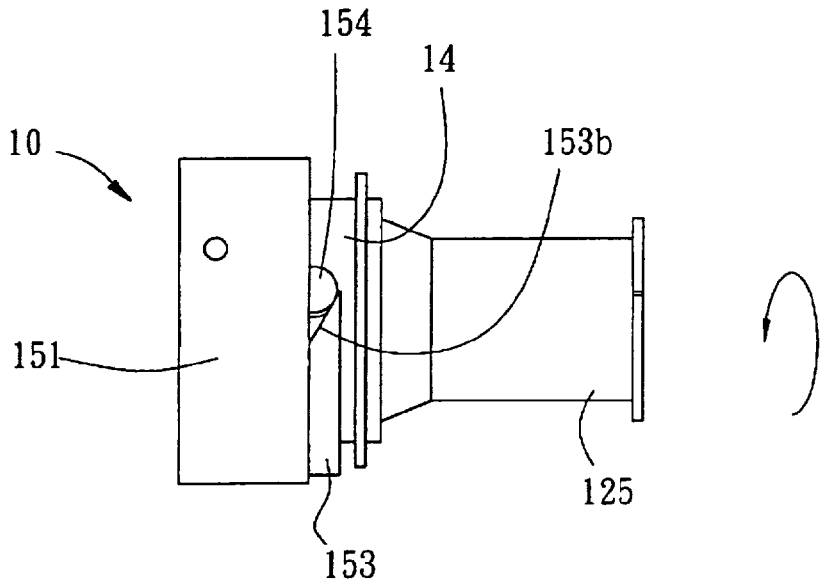
FIG. 6 and FIG. 7 are schematic plain views of a part of the transmission mechanism of the window blind control structure according to the first preferred embodiment of the present invention, showing the relative motion among the amplitude (lift cord) modulation control device, the frequency (ladder tape) modulation control device, and the corresponding clutch.
Figure 7:
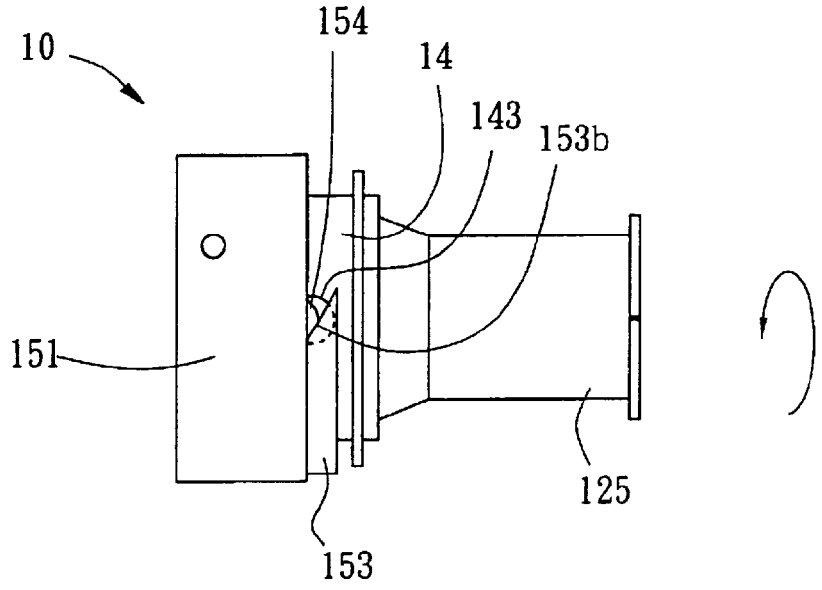
Figure 8:
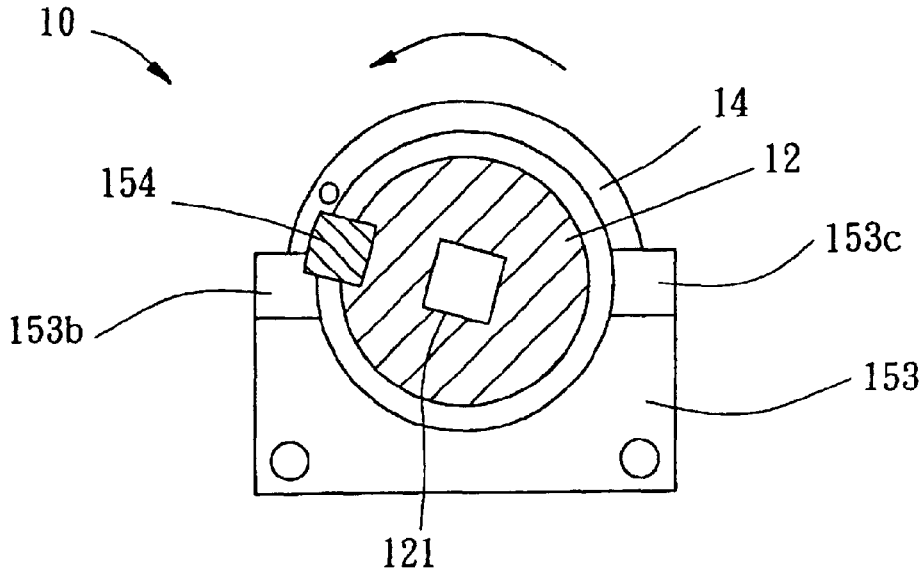
FIG. 8 and FIG. 9 are schematic sectional end views of a part of the transmission mechanism of the window blind control structure according to the first preferred embodiment of the present invention, showing the relative motion among the amplitude (lift cord) modulation control device, the frequency (ladder tape) modulation control device, and the corresponding clutch.
Figure 9:
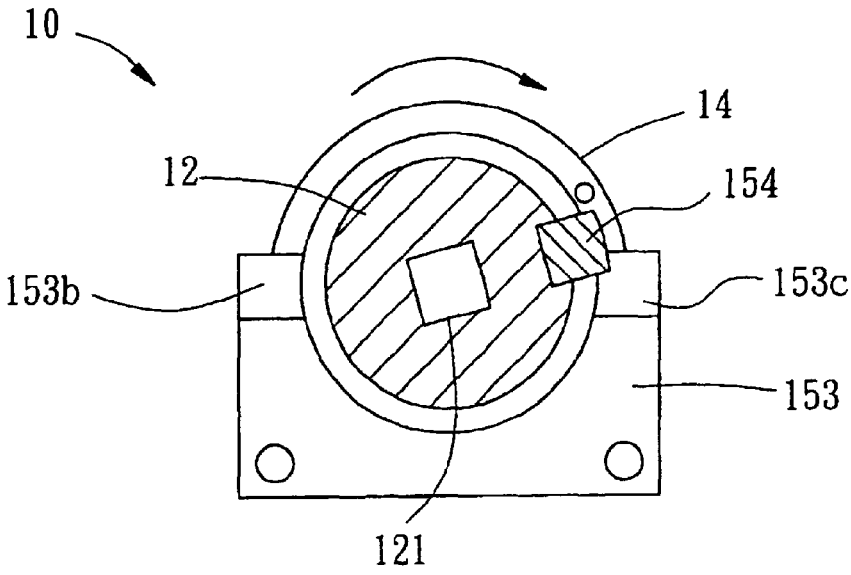
Figure 10:
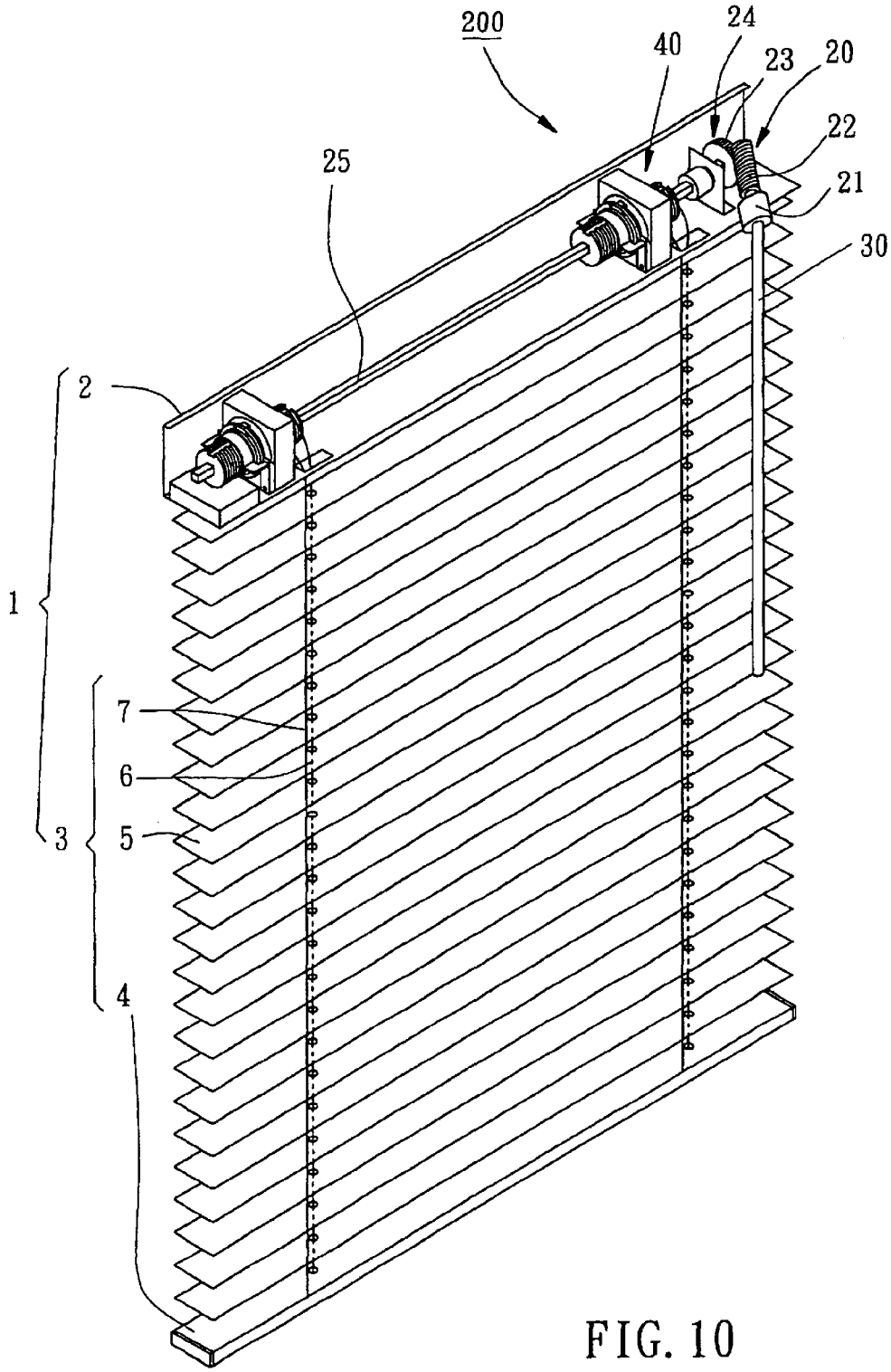
FIG. 10 illustrates a window blind control structure installed in a window blind according to a second preferred embodiment of the present invention.
Figure 11:
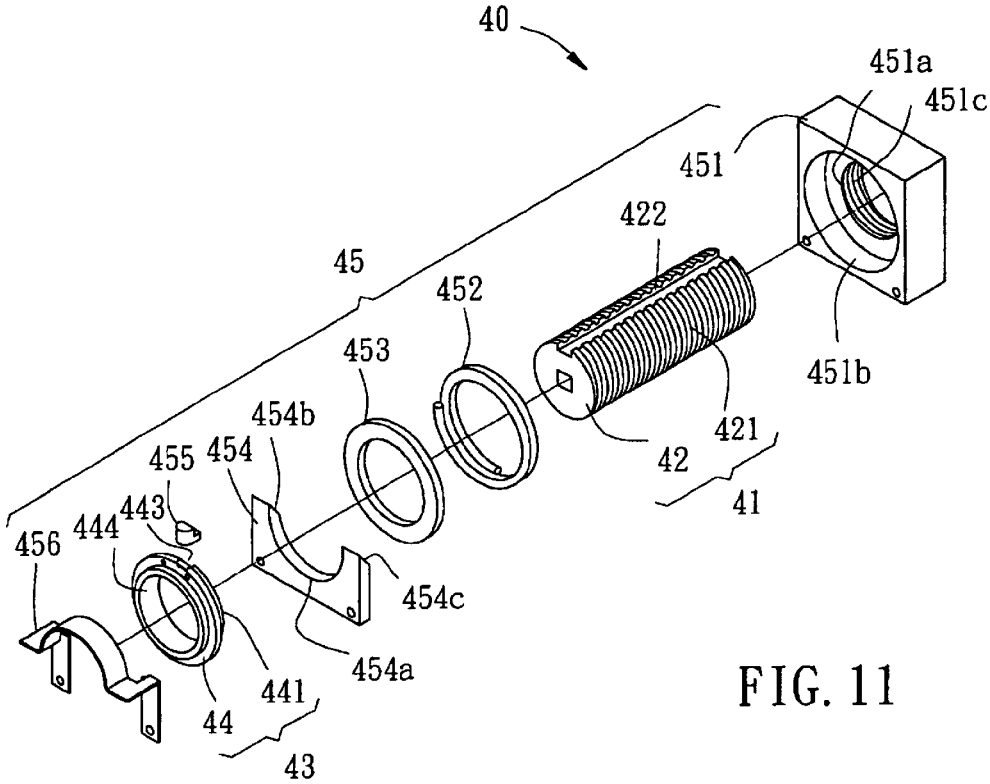
FIG. 11 is an exploded view of one symmetrical half of the transmission mechanism of the window blind control structure according to the second preferred embodiment of the present invention.
Figure 12:
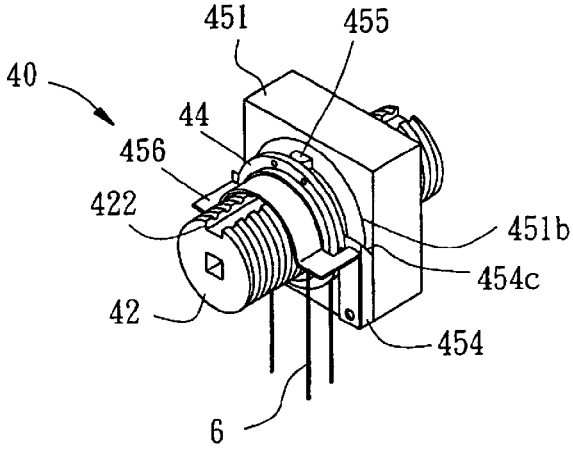
FIG. 12 is an assembly view of FIG. 11.
Figure 13:
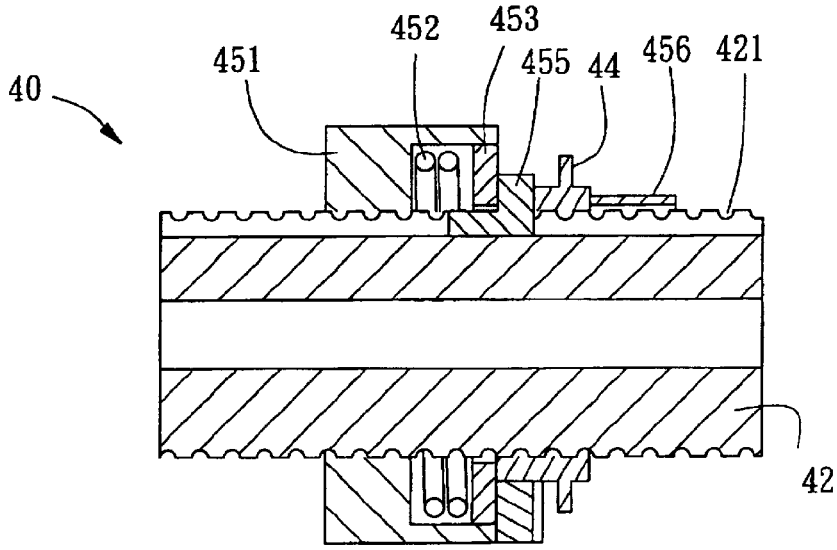
FIG. 13 is a sectional side view in an enlarged scale of a part of FIG. 10, showing the structure of the transmission mechanism.
Figure 14:
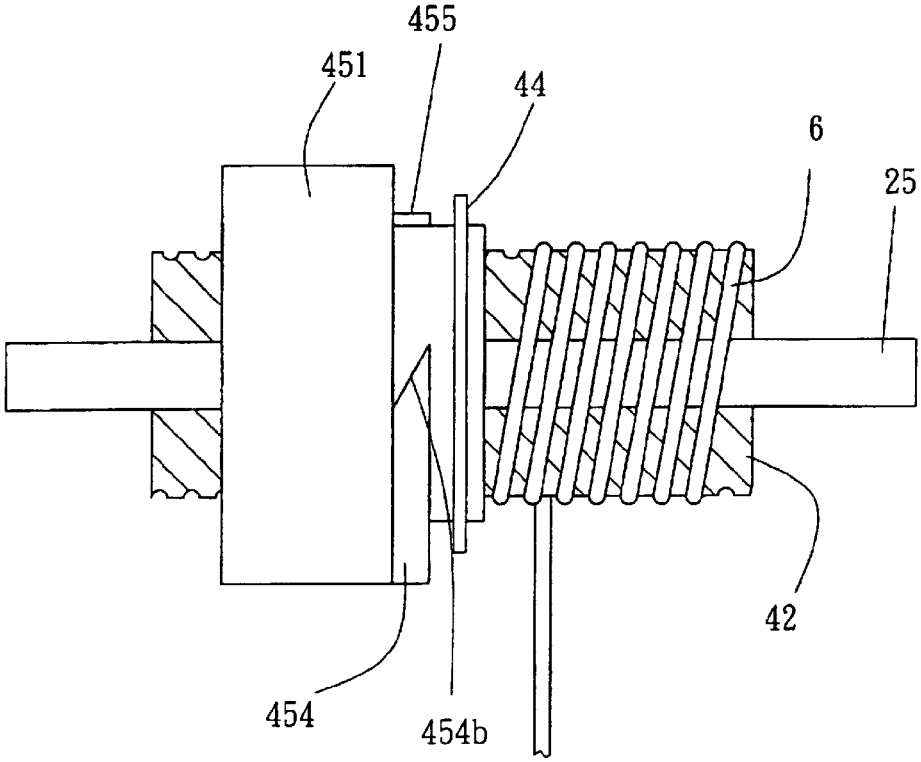
FIG. 14 is a schematic plain view in an enlarged scale of a part of FIG. 10, showing the lift cord wound round the tail of the corresponding amplitude control wheel.
Figure 15:
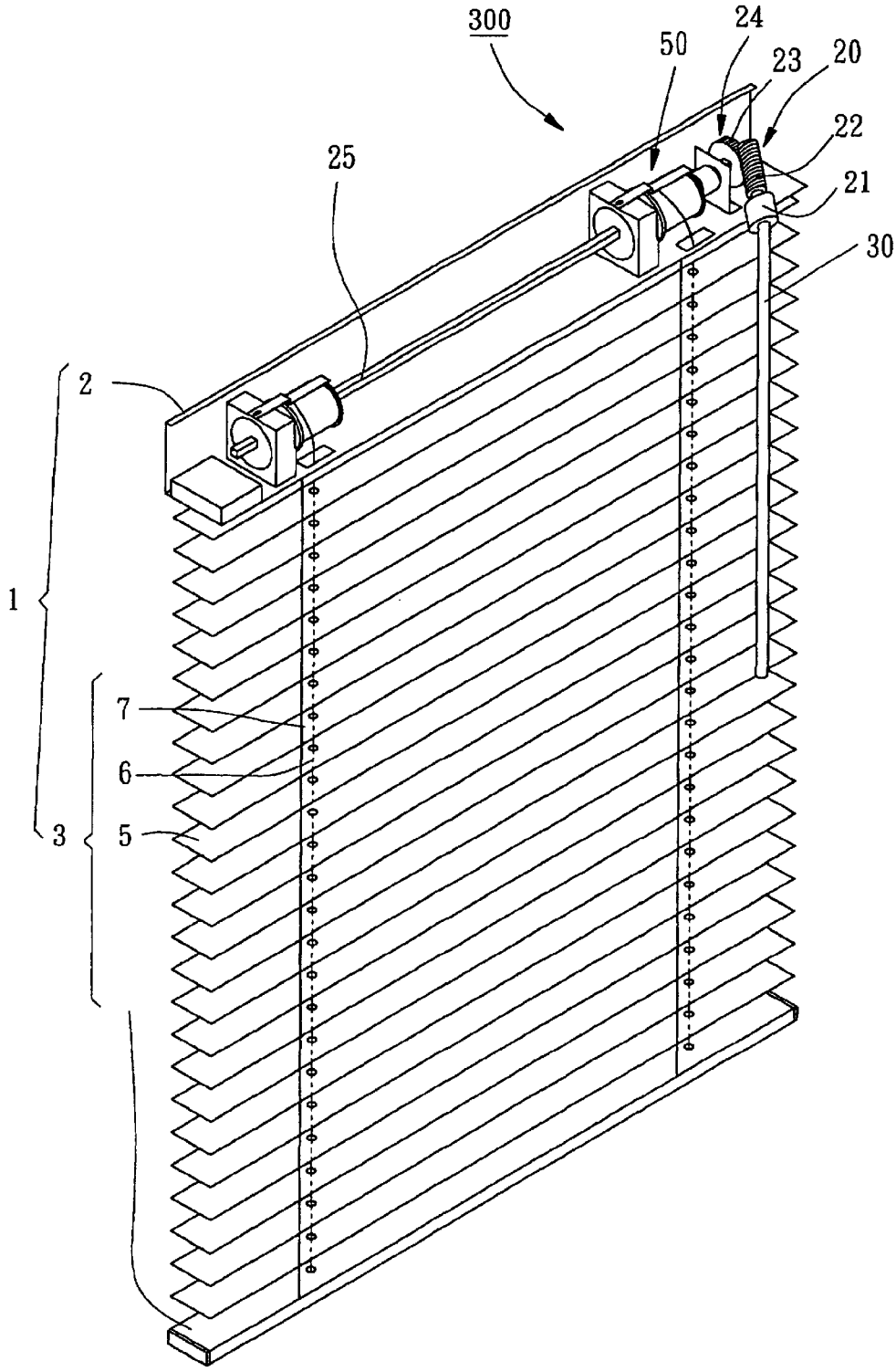
FIG. 15 illustrates a window blind control structure installed in a window blind according to a third preferred embodiment of the present invention.
Figure 16:
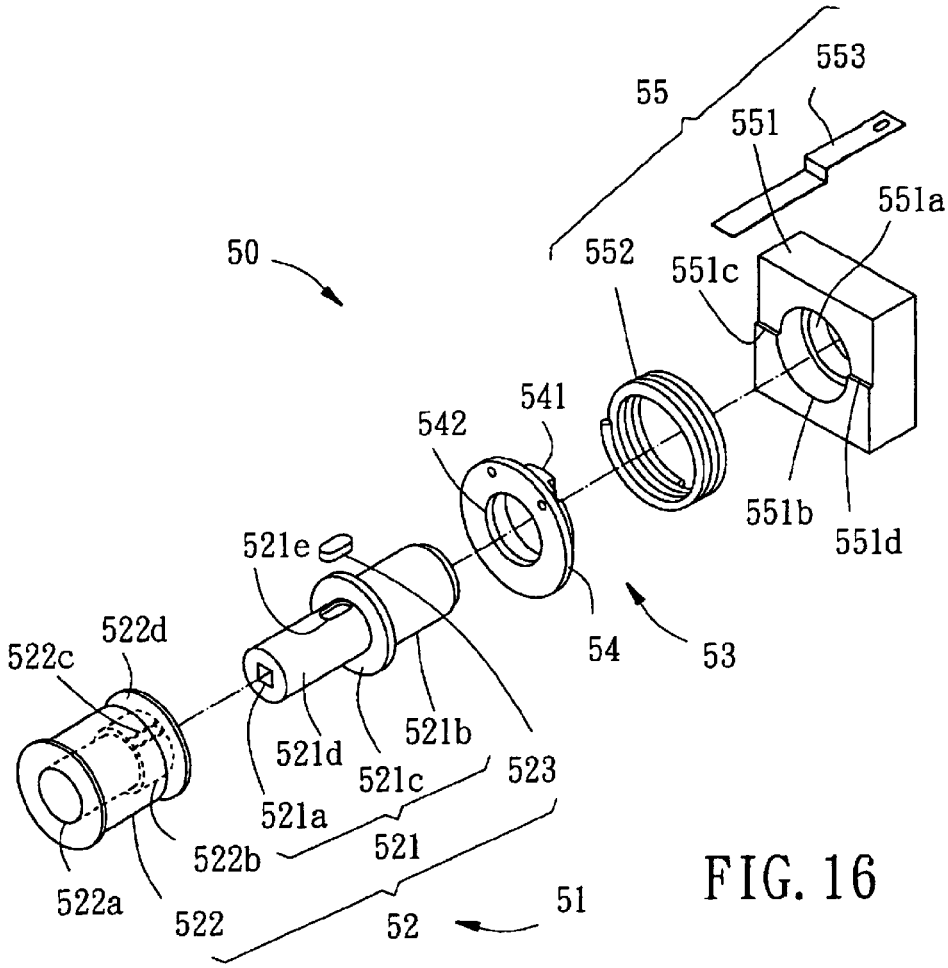
FIG. 16 is an exploded view of one symmetrical half of the transmission mechanism of the window blind control structure according to the third preferred embodiment of the present invention.
Figure 17:
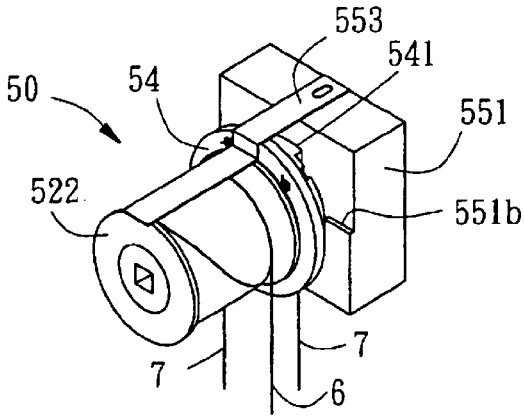
FIG. 17 is an assembly view of FIG. 16.
Figure 18:
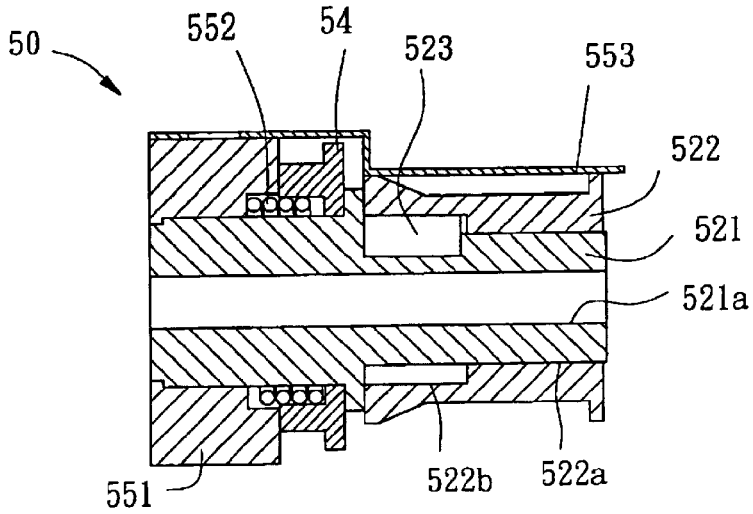
FIG. 18 is a sectional side view of the assembly shown in FIG. 17.
Figure 19:
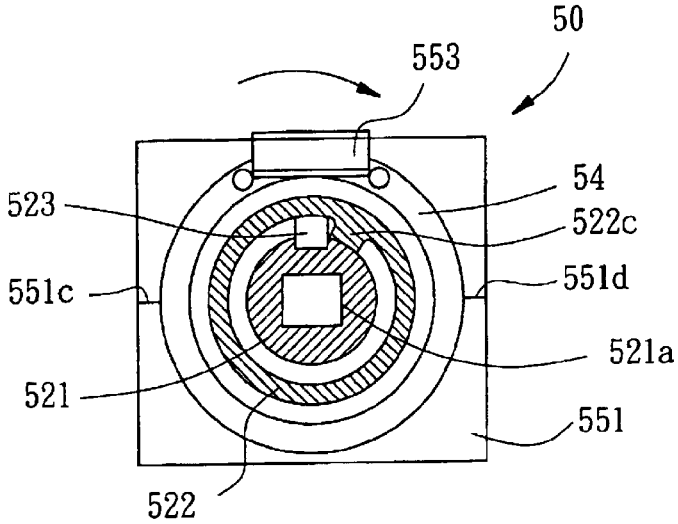
FIG. 19 is a sectional end of the assembly shown in FIG. 17, showing the amplitude control wheel rotated in clockwise direction.
Figure 20:
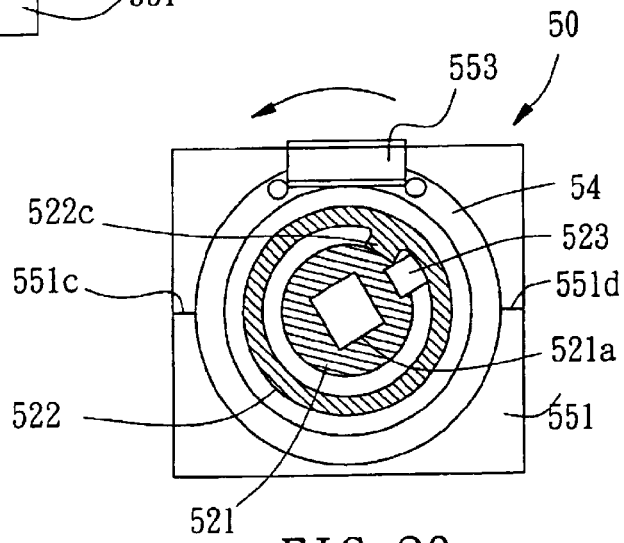
FIG. 20 is similar to FIG. 19 but showing the amplitude control wheel rotated in counter-clockwise direction.

The links 154 of the clutches 15 are respectively coupled between the respective amplitude control wheels 12 and the respective frequency control wheels 14 at the initial state during the amplitude control mode. Therefore, during the initial stage of the rotary motion of the amplitude control wheels 12 the frequency control wheels 14 are rotated with the amplitude control wheels 12 to roll up the ladder tapes 7 and to further tilt the slats 5. When the link 154 of each clutch 15 touched one sloping face 153*b* of the stop block 153 of respective clutch 15 during rotary motion of the frequency control wheels 14 with the respective amplitude control wheels 12 (see FIGS. 6 and 8), the link 154 of each clutch 15 is forced to move along the sloping face 153*b* of the corresponding stop block 153 into the circular recessed hole 151*b* of the corresponding holder base 151 to compress the corresponding spring member 152, and therefore the link 154 of each clutch 15 is disengaged from the groove 143 of the corresponding frequency control wheel 14 (see FIG. 7) to separate the connection between the frequency control wheel 14 and the corresponding amplitude control wheel 12. After disconnection of the frequency control wheel 14 of each frequency (ladder tape) modulation control device 13 from the amplitude control wheel 12 of the corresponding amplitude modulation control device 12, the frequency control wheels 14 of the frequency (ladder tape) modulation control devices 13 are not rotated with the amplitude control wheels 12 of the amplitude (lift cord) modulation control devices 11, and the amplitude control wheels 12 of the amplitude (lift cord) modulation control devices 11 are continuously rotated to roll up the lift cords 6 and to further receive the slats 5.

When opening (extending out) the slats 5 of the blind body 3, rotate the operation device 30 in the reversed directions (reversed to the slat receiving operation) to rotate the double-thread worm 22, the worm gear 23 and the rod member 25 in the reversed direction, thereby causing the amplitude control wheels 12 of the amplitude (lift cord) modulation control devices 11 of the transmission mechanism 10 to let off the lift cords 6, and therefore the bottom rail 4 and the slats 5 are lowered to the desired elevation.

At the initial stage of the rotary motion of the amplitude control wheels 12, the frequency control wheels 14 are separated from the amplitude control wheels 12 due to the effect of the sloping faces 153*b* of the stop blocks 153 of the clutches 15. When the links 154 carried by the corresponding amplitude control wheels 12 to the position in line with the grooves 143 of the corresponding frequency control wheels 14, the respective spring members 152 immediately force the links 154 into the grooves 143 of the corresponding frequency control wheels 14, thereby causing the frequency control wheels 14 to be linked to the respective amplitude control wheels 12 by the respective links 154 for synchronous rotation. When the links 154 moved with the corresponding amplitude control wheels 12 from the sloping faces 153*b* of the respective stop blocks 153 to the sloping faces 153*c*, the links 154 are forced away from the grooves 143 of the respective frequency control wheels 14 to disconnect the frequency control wheels 14 from the respective amplitude control wheels 12, enabling the amplitude control wheels 12 to be continuously rotated to let off the lift cords 6 and to further open the slats 5.

With Respect to frequency control (slat tilting control):

At first, rotate the control device 30 with the hand to further rotate the amplitude control wheels 12 of the amplitude modulation control devices 11 of the transmission mechanism 10. Because the links 154 are respectively coupled between the amplitude control wheels 12 and the frequency control wheels 14 at this time, rotating the amplitude control wheels 12 cause the frequency control wheels 14 to roll up the ladder tapes 7 and to further tilt the slats 5. Because it is not necessary to tilt the slats 5 through a wide angle during operation, the synchronous rotation of the amplitude control wheels and the frequency control wheels 14 can be controlled within a predetermined range (about 180°). When tilted the slats 5 to the desired tilted position, stop the rotation of the operation device 30, keeping the slats 5 in the adjusted tilted position (during the aforesaid operation procedure, the amount of vertical displacement of the bottom rail 4 following rotary motion of the amplitude control wheels 12 is quite small and does not affect the reliability of the operation).

According to the above statement, the control structure 100 has numerous advantages as outlined hereinafter.

Because the invention uses a rod-like operation device to control lifting and tilting of the slats, the lift cords are hidden in the window body, preventing hanging of exposed cord members on a child accidentally.

Because the invention uses one operation device to control lifting and tilting of the slats, the control of the window blind is easy (one single operation source), and the exposed parts are minimized (conventional tilting rod is eliminated). Because the invention eliminates the conventional split type frequency control mechanism, the control structure requires less installation.

Further, when receiving the slats, the gravity weight of the bottom rail and the slats may reverse the amplitude modulation control devices and frequency modulation control devices. The invention eliminates this problem. According to the present invention, the linking mechanism works as self-locking means to automatically lock the slats in position after each operation of the operation device, i.e., the worm can be driven to rotate the worn gear; however the worm gear cannot be driven to rotate the worm (the worm and worm gear form a force multiplier). An additional self-locking device may be used to lock the linking mechanism after each operation of the operation device in case the bottom rail and the slats are excessively heavy. This self-locking device is operated manually by the user. It enhances the security of the window blind. Because this self-locking device is a common device available on the market, no further detailed description in this regard is necessary.

FIGS. 10~14 show a window blind control structure 200 according to a second preferred embodiment of the present invention. According to this second embodiment, the window blind 1, the linking mechanism 20, and the operation device 30 are identical to like parts in the aforesaid first preferred embodiment of the present invention; however the transmission mechanism 40 is different from the transmission mechanism of the aforesaid first embodiment of the present invention.

The transmission mechanism 40 comprises two amplitude (lift cord) modulation control devices 41, two frequency (ladder tape) modulation control devices 43, and two clutches 45. The amplitude modulation control devices 41, the frequency modulation control devices 43, and the clutches 45 are respectively bilaterally mounted inside the headrail 2 corresponding to the lift cords 6 and the ladder tapes 7.

Each amplitude (lift cord) modulation control device 41 comprises an amplitude control wheel 42. The amplitude control wheel 42 is a cylindrical member having an axial center through hole 423 of non-circular cross-section axially extended through the two distal ends, an outer thread 421 extended around the periphery, and a longitudinal sliding groove 422 longitudinally extended in the periphery and cut through the outer thread 421.

Each clutch 45 is comprised of a holder base 451, a spring member 452, a pressure ring 453, a stop block 454, a link 455, and a limiter 456. The holder base 451 has a circular center through hole 451*a*, a circular recessed hole 451*b* in one side around the center through hole 451*a*, and an inner thread 451*c* extended around the periphery of the center through hole 451*a* and threaded onto the outer thread 421 of the corresponding amplitude control wheel 42. The spring member 452 is a coil spring sleeved onto the corresponding amplitude control wheel 42 and received in the circular recessed hole 451*b* of the corresponding holder base 451, having one end stopped at the step between the circular recessed hole 451*b* and center through hole 451*a* in the corresponding holder base 451 and the other end stopped at the corresponding pressure ring 453. The pressure ring 453 is sleeved onto the corresponding amplitude control wheel 42 and supported on the spring member 452. The stop block 454 is affixed to the corresponding holder base 451, having a smoothly arched notch 454*a* fitting the periphery of the circular recessed hole 451*b* of the corresponding holder base 451, and two sloping faces 453*b* and 453*c* respectively downwardly extended from the top at two sides of the smoothly arched notch 453*a* toward the circular recessed hole 451*b* of the corresponding holder base 451. The link 455 is a substantially L-shaped key member mounted in the longitudinal sliding groove 422 of the corresponding amplitude control wheel 42. Each frequency (ladder tape) modulation control 43 comprises a frequency control wheel 44. The structure of the frequency control wheel 44 is similar to the frequency control wheel of the aforesaid first embodiment of the present invention. By means of the circular through hole 444, the frequency control wheel 44 is sleeved onto the corresponding amplitude control wheel 42, for enabling the corresponding link 455 to partially engage into the longitudinal sliding groove 422 of the corresponding amplitude control wheel 42 and partially engage into the groove 443 of the corresponding frequency control wheel 44 to couple the corresponding frequency control wheel 44 to the corresponding amplitude control wheel 42 for synchronous rotation. The limiter 456 is affixed to the corresponding holder base 451 to stop the corresponding frequency control wheel 44 from falling out of the amplitude control wheel 42.

Therefore, the link 455 can be coupled between the corresponding amplitude control wheel 42 and the corresponding frequency control wheel 44, or forced by the sloping faces 454*b* and 454*c* of the corresponding stop block 454 to separate the amplitude control wheel 42 from the frequency control wheel 44. Therefore, this embodiment enables the user to lift/lower the slats and to tilt the slats by means of a common driving source (control device). Because the amplitude control wheel 42 is fastened to the corresponding holder base 451 through a screw joint, the amplitude control wheel 42 can be rotated forwards/backwards relative to the corresponding holder base 451 to roll up the corresponding lift cord 6, keeping the corresponding lift cord 6 wound round the outer thread 421 smoothly in a good order (see FIG. 14).

FIGS. 15~20 show a window blind control structure 300 according to a third preferred embodiment of the present invention. According to this third embodiment, the window blind 1, the linking mechanism 20, and the operation device 30 are identical to like parts in the aforesaid first and second embodiments of the present invention; however the transmission mechanism 50 is different from the transmission mechanism of the aforesaid first or second embodiment of the present invention.

According to this embodiment, the transmission mechanism 50 is comprised of two amplitude (lift cord) modulation control devices 51, frequency (ladder tape) modulation control devices 53, and two clutches 55. The amplitude modulation control devices 51, the frequency modulation control devices 53, and the clutches 55 are respectively bilaterally mounted inside the headrail 2 corresponding to the lift cords 6 and the ladder tapes 7.

Each amplitude (lift cord) modulation control device 51 comprises an amplitude control wheel 52. The amplitude control wheel 52 is comprised of a wheel shaft 521, a bobbin 522, and a key 523. The wheel shaft 521 comprises a mounting portion 521*b* at one end, a bearing portion 521*d* at the other end, an annular stop flange 521*c* extended around the periphery between the mounting portion 521*b* and the bearing portion 521*d*, an axial center through hole 521*a* of non-circular cross-section axially extended through the mounting portion 521*b* and the bearing portion 521*d*, and a key hole 521*e* formed in the bearing portion 521*d* adjacent to the annular stop flange 521*c* and adapted to accommodate the key 523. The bobbin 522 is sleeved onto the bearing portion 521*d* of the wheel shaft 521, comprising a first axial center hole 522*a* extended to one end and fitting the outer diameter of the bearing portion 521*d* of the wheel shaft 521, a second axial center hole 522*b* extended to the other end in communication and line with the first axial center hole 522*a*, the second axial center hole 522*b* having a diameter greater than the outer diameter of the bearing portion 521*d* of the wheel shaft 521, an inside projection 522*c* suspended in the second axial center hole 522*b* and disposed in contact with the periphery of the bearing portion 521*d* of the wheel shaft 521, and a tapered face 522*d* extended around the periphery of one end of the bobbin 522. The key 523 is mounted in the key hole 521*e* of the wheel shaft 521, and partially protruded over the periphery of the bearing portion 521*d* of the wheel shaft 521. The lift cords 6 have the respective top ends respectively fastened to the bobbins 522 of the amplitude control wheels 52 of the amplitude (lift cord) modulation control devices 51. When rotating the bobbin 522 of each amplitude control wheel 52 to roll up the corresponding lift cord 6, the lift cord 6 is guided by the tapered face 522*d* and wound round the bobbin 522 smoothly in a good order.

Each frequency (ladder tape) modulation control device 53 comprises a frequency control wheel 54. The frequency control wheel 54 comprises a center through hole 542, which receives the mounting portion 521*b* of the wheel shaft 521 of the corresponding amplitude control wheel 52, and a protruded portion 541 projecting from one side around the center through hole 542.

Each clutch 55 is comprised of a holder base 551, a spring member 552, and a limiter 553. The holder base 551 is fixedly mounted in the headrail 2, having a circular center through hole 551*a*, a circular recessed hole 551*b* in one side around the center through hole 551*a*, and two shoulders 551*c* and 551*d* at two sides of the circular recessed hole 551*b* and adapted to stop the protruded portion 541 of the corresponding frequency control wheel 54 to limit the angle of rotation of the corresponding frequency control wheel 54. The spring member 552 is mounted in the circular recessed hole 551*b* and stopped between the holder base 551 and the corresponding frequency control wheel 54, keeping the corresponding frequency control wheel 54 in friction contact with the annular stop flange 521*c* of the wheel shaft 521 of the corresponding amplitude control wheel 52. The limiter 553 is affixed to the holder base 551 to stop the corresponding frequency control wheel 54 from falling out of the corresponding amplitude control wheel 52.

Therefore, the spring power of the spring member 552 impart a push force to the corresponding frequency control wheel 54, holding the corresponding frequency control wheel 54 in friction engagement with the annular stop flange 521*c* of the wheel shaft 521 of the corresponding amplitude control wheel 52. When the protruded portion 541 of the frequency control wheel 54 stopped at one shoulder 551*c* or 551*d* of the corresponding holder base 551 during rotary motion of the frequency control wheel 54 with the corresponding amplitude control wheel 52, a reactive force is produced (which surpasses the friction force between the frequency control wheel 54 and the annular stop flange 521*c* of the wheel shaft 521 of the corresponding amplitude control wheel 52), thereby causing the frequency control wheel 54 to be disengaged from the corresponding amplitude control wheel 52. Therefore, similar to the aforesaid first and second embodiments of the present invention, the third embodiment achieves blind slat lifting and tilting control through one single driving source.

Further, at the initial stage in which the wheel shaft 521 is rotated by the rod member 25, the inside projection 522*c* of the bobbin 522 does not touch the key 523, and the wheel shaft 521 runs idle. After the key 523 stopped against the inside projection 522*c* of the bobbin 522 (see FIG. 19 or FIG. 20), the bobbin 522 is rotated with the wheel shaft 521. When the wheel shaft 521 runs idle, the blind slats are tilted, and the bobbin 522 of the amplitude control wheel 52 of each amplitude (lift cord) modulation control device 51 does no work, i.e. the elevation of the slats does not change.

It is to be understood that the aforesaid rod-like operation device 30 can be formed integral with the input member 21. Alternatively, the operation device 30 can be detachably coupled to the input member 21. For example, the operation device 30 can be made having a coupling device or connector at the top end detachably coupled to a coupling device or connector at the bottom side of the input member 21. When not in use, the operation device 30 can be detached from the input member 21.

Further, a power drive may be installed in the operation device 30, and controlled to bias the input member 21 automatically. For example, a motor is installed in the bottom end of the operation device 30, and an output member is provided at the top end of the operation device 30 and coupled to the input member 21. When started the motor, the output member is driven by the motor to bias the input member.

What is claimed is:

1. A window blind control structure adapted to be installed in a window blind having a headrail and a window body suspended from said headrail, the window blind control structure comprising:

a transmission mechanism mounted in said headrail of said window blind, said transmission mechanism having at least one amplitude modulation control device coupled to said window body for controlling lifting of said blind body, at least one frequency modulation control device coupled to said window body for controlling tilting of said window body, and at least one clutch coupled to said amplitude modulation control device and said frequency modulation control device for controlling synchronous action between said amplitude modulation control device and said frequency modulation control device;

a linking mechanism mounted in said headrail and coupled to said transmission mechanism, said linking mechanism having an input member adapted to receive an external biasing force, and an actuating member coupled between said input member and said transmission mechanism and adapted to drive said transmission mechanism upon action of said input member; and an operation device coupled to said input member of said linking mechanism for operation by the user to bias said input member;

wherein said at least one amplitude modulation control device each comprises an amplitude control wheel; said at least one clutch each comprises a holder base, said holder base having a recessed hole formed in one side thereof and adapted to accommodate the amplitude control wheel of one of said at least one amplitude modulation control device;

wherein said at least one frequency modulation control device each comprises a frequency control wheel, said frequency control wheel comprising a circular through hole, which receives one amplitude control wheel of said at least one amplitude modulation control device; said at least one clutch each further comprises a limiter affixed to the holder base of the corresponding clutch and adapted to stop the corresponding frequency control wheel from falling out of the corresponding amplitude control wheel;

wherein said amplitude control wheel has a longitudinal slot formed in the periphery of one end thereof inside the holder base of one of said at least one clutch; said at least one frequency modulation control device each comprises a frequency control wheel, said frequency control wheel having a groove; said at least one clutch each further comprises a spring member mounted in the slot of the amplitude control wheel and stopped at one end thereof with the slot, and a link mounted in the slot of the amplitude control wheel and supported on the other end of said spring member and engageable into the groove of the frequency control wheel of the corresponding frequency modulation control device being mounted on the corresponding amplitude control wheel for enabling the corresponding frequency control wheel to be synchronously rotated with the corresponding amplitude control wheel; and wherein said at least one clutch each further comprises a stop block affixed to one side of the corresponding holder base around the recessed hole of the corresponding holder base, said stop block having a smoothly arched notch formed in a top side thereof and fitting the periphery of the recessed hole of the corresponding holder base, and two sloping faces respectively downwardly extended from two sides of said smoothly arched notch toward the recessed hole of the corresponding holder base and adapted to force the corresponding link away from the corresponding frequency control wheel after rotation of the frequency control wheel of each of said at least one frequency modulation control device with the amplitude control wheel of each of said at least one amplitude modulation control device through a predetermined angle.

2. The window blind control structure as claimed in claim 1, wherein said input member is rotatably pivoted to said headrail and substantially axially extended in vertical, having a top end mounted with a double-thread worm; said actuating member is a worm gear fastened pivotally with said headrail and meshed with said double-thread worm; said linking mechanism further comprises a rod member axially extended from a center of said worm gear for synchronous rotation and horizontally suspended inside said headrail.

3. The window blind control structure as claimed in claim 1, wherein said operation device is a rod member fixedly extended from a bottom side of said input member to the outside of said headrail for operation by the user.

4. The window blind control structure as claimed in claim 1, wherein said operation device is a rod member having a top end terminating in a coupling device and a bottom end for holding by the user; said input device has a coupling device disposed in a bottom side thereof outside said headrail and adapted to receive the coupling portion of said operation device.

5. The window blind control structure as claimed in claim 1, wherein said operation device comprises a motor mounted in a bottom end thereof, an output member mounted in a top end thereof and coupled to said motor and connectable to said input member for biasing said input member upon operation of said motor.

6. The window blind control structure as claimed in claim 1, wherein said at least one amplitude modulation control device each comprises an amplitude control wheel, said amplitude control wheel having an axial center through hole axially extended through two distal ends thereof, the axial center through hole of said amplitude control wheel having a non-circular cross-section; said linking mechanism further comprises a rod member connected to said actuating member and adapted to couple said actuating member to said transmission mechanism, said rod member having a noncircular cross-section fitting the axial center through hole of said amplitude control wheel.

7. A window blind control structure adapted to be installed in a window blind having a headrail and a window body suspended from said headrail, the window blind control structure comprising:

a transmission mechanism mounted in said headrail of said window blind, said transmission mechanism having at least one amplitude modulation control device coupled to said window body for controlling lifting of said blind body, at least one frequency modulation control device coupled to said window body for controlling tilting of said window body, and at least one clutch coupled to said amplitude modulation control device and said frequency modulation control device for controlling synchronous action between said amplitude modulation control device and said frequency modulation control device;

a linking mechanism mounted in said headrail and coupled to said transmission mechanism, said linking mechanism having an input member adapted to receive an external biasing force, and an actuating member coupled between said input member and said transmission mechanism and adapted to drive said transmission mechanism upon action of said input member; and an operation device coupled to said input member of said linking mechanism for operation by the user to bias said input member;

wherein said at least one amplitude modulation control device each comprises an amplitude control wheel, said amplitude control wheel having an outer thread extended around the periphery thereof, said at least one clutch each comprises a holder base, said holder base having an axially extended center through hole and an inner thread extended around the periphery of the axially extended center through hole and threaded onto the outer thread of the amplitude control wheel of one of said at least one amplitude modulation control device for enabling the corresponding amplitude control wheel to be rotated forwards and backwards relative to the corresponding holder base.

8. The window blind control structure as claimed in claim 7, wherein the amplitude control wheel of each of said at least one amplitude modulation control device further has a longitudinal sliding groove longitudinally extended across the outer thread; said at least one frequency modulation control device each comprises a frequency control wheel sleeved onto the amplitude control wheel of one of said at least one amplitude modulation control device, said frequency control wheel having a groove; said at least one clutch each further comprises a link mounted in the longitudinal sliding groove of the amplitude control wheel of one of said at least one amplitude modulation control device and partially engaged into the groove of the frequency control wheel of one of said at least one frequency modulation control device for enabling the corresponding frequency control wheel to be rotated with the corresponding amplitude control wheel.

9. The window blind control structure as claimed in claim 8, wherein said holder base has a recessed hole formed in one side thereof around the axially extended center through hole; said at least one clutch each further comprises a spring member sleeved onto the amplitude control wheel of one of said at least one amplitude modulation control device and supported on a step inside the corresponding holder base, and a pressure ring supported between said spring member and the corresponding link to force said link into engagement with the groove of the corresponding frequency control wheel for enabling the corresponding frequency control wheel to be rotated with the corresponding amplitude control wheel.

10. The window blind control structure as claimed in claim 8, wherein said at least one clutch each further comprises a stop block affixed to the corresponding holder base, said stop block having two sloping faces adapted to force the corresponding link away from the groove of the corresponding frequency control wheel after rotation of the frequency control wheel of each of said at least one frequency modulation control device with the amplitude control wheel of each of said at least one amplitude modulation control device through a predetermined angle.

11. A window blind control structure adapted to be installed in a window blind having a headrail and a window body suspended from said headrail, the window blind control structure comprising:

a transmission mechanism mounted in said headrail of said window blind, said transmission mechanism having at least one amplitude modulation control device coupled to said window body for controlling lifting of said blind body, at least one frequency modulation control device coupled to said window body for controlling tilting of said window body, and at least one clutch coupled to said amplitude modulation control device and said frequency modulation control device for controlling synchronous action between said amplitude modulation control device and said frequency modulation control device;

a linking mechanism mounted in said headrail and coupled to said transmission mechanism, said linking mechanism having an input member adapted to receive an external biasing force, and an actuating member coupled between said input member and said transmission mechanism and adapted to drive said transmission mechanism upon action of said input member; and an operation device coupled to said input member of said linking mechanism for operation by the user to bias said input member;

wherein said at least one amplitude modulation control device each comprises an amplitude control wheel, said amplitude control wheel comprising a wheel shaft coupled to said linking mechanism, said wheel shaft having a key hole in the periphery thereof, a bobbin sleeved onto said wheel shaft, said bobbin having a first axial center hole extended to one end thereof, a second axial center hole extended to an opposite end thereof in communication and line with said first axial center hole, said second axial center hole having a diameter greater than said first axial center hole, and an inside projection suspended in said second axial center hole and disposed in contact with the periphery of said wheel shaft, and a key mounted in the key hole of said wheel shaft and partially protruded over the periphery of said wheel shaft and adapted to stop and push the inside projection of said bobbin and to further rotate said bobbin upon rotary motion of said wheel shaft.

12. The window blind control structure as claimed in claim 11, wherein said wheel shaft has a center trough hole axially extended through two distal ends thereof, the center through hole of said wheel shaft having a non-circular cross-section; said linking mechanism comprises a non-circular rod member fitted into the center through hole of said wheel shaft to couple said wheel shaft to said linking mechanism.

13. The window blind control structure as claimed in claim 11, wherein said inside projection of said bobbin spaces the periphery of said second axial center hole from the periphery of said wheel shaft, for enabling said bobbin to be rotated relative to said wheel shaft within a predetermined angle.

14. The window blind control structure as claimed in claim 11, wherein said wheel shaft comprises a bearing portion adapted to support said bobbin, said bearing portion having an outer diameter approximately equal to the first axial center hole of said bobbin.

15. The window blind control structure as claimed in claim 14, wherein said wheel shaft further comprises a mounting portion axially extended from one end of said bearing portion, and an annular stop flange extended around the periphery between said mounting portion and said bearing portion; said at least one frequency modulation control device each comprises a frequency control wheel, said frequency control wheel having a center through hole, which receives of the mounting portion of the wheel shaft of the amplitude control wheel of one of said at least one amplitude modulation control device for enabling said frequency control wheel to be maintained in friction contact with the annular stop flange of the wheel shaft of the corresponding amplitude control wheel.

16. The window blind control structure as claimed in claim 15, wherein said at least one clutch each comprises a holder base, said holder base comprising a center through hole and a recessed hole formed in one side thereof around said center through hole, a spring member supported in the recessed hole of said holder base and stopped between said holder base and the frequency control wheel of one of said at least one frequency modulation control device to force the corresponding frequency control wheel into friction contact with the annular stop flange of the wheel shaft of the amplitude control wheel of one of said at least one amplitude modulation control device.

17. The window blind control structure as claimed in claim 16, wherein said at least one clutch each further comprises a limiter affixed to the corresponding holder base and adapted to stop the corresponding frequency control wheel from falling out of the corresponding amplitude control wheel.

18. The window blind control structure as claimed in claim 16, wherein the frequency control wheel of each of said at least one frequency modulation control device has a protruded portion projecting from one side thereof-, the holder base of each of said at least one clutch has two shoulders disposed at two sides of the recessed hole of the corresponding holder and adapted to stop the protruded portion of the corresponding frequency control wheel during rotary motion of the corresponding frequency control wheel with the corresponding amplitude control wheel and to further force the corresponding frequency control wheel out of engagement with the corresponding amplitude control wheel.

19. The window blind control structure as claimed in claim 18, wherein the reactive force upon contact of the protruded portion of the frequency control wheel with one shoulder of the corresponding holder base is greater than the friction resistance between the corresponding frequency control wheel and the corresponding amplitude control wheel.

20. A window blind control structure adapted to be installed in a window blind having a headrail and a window body suspended from said headrail, the window blind control structure comprising:

a transmission mechanism mounted in said headrail of said window blind, said transmission mechanism having at least one amplitude modulation control device coupled to said window body for controlling lifting of said blind body, at least one frequency modulation control device coupled to said window body for controlling tilting of said window body, and at least one clutch coupled to said amplitude modulation control device and said frequency modulation control device for controlling synchronous action between said amplitude modulation control device and said frequency modulation control device;

a linking mechanism mounted in said headrail and coupled to said transmission mechanism, said linking mechanism having an input member adapted to receive an external biasing force, and an actuating member coupled between said input member and said transmission mechanism and adapted to drive said transmission mechanism upon action of said input member; and an operation device coupled to said input member of said linking mechanism for operation by the user to bias said input member;

wherein said linking mechanism further comprises self-locking means, which allows said input device to bias said actuating member but prohibits said actuating member from biasing said input member.

21. The window blind control structure as claimed in 20, wherein said at least one amplitude modulation control device each comprises an amplitude control wheel; said at least one clutch each comprises a holder base, said holder base having a recessed hole formed in one side thereof and adapted to accommodate the amplitude control wheel of one of said at least one amplitude modulation control device.

22. The window blind control structure as claimed in claim 20, wherein said at least one frequency modulation control device each comprises a frequency control wheel, said frequency control wheel comprising a circular through hole, which receives one amplitude control wheel of said at least one amplitude modulation control device; said at least one clutch each further comprises a limiter affixed to the holder base of the corresponding clutch and adapted to stop the corresponding frequency control wheel from falling out of the corresponding amplitude control wheel.

23. The window blind control structure as claimed in claim 20, wherein said amplitude control wheel has a longitudinal slot formed in the periphery of one end thereof inside the holder base of one of said at least one clutch; said at least one frequency modulation control device each comprises a frequency control wheel, said frequency control wheel having a groove; said at least one clutch each further comprises a spring member mounted in the slot of the amplitude control wheel and stopped at one end thereof with the slot, and a link mounted in the slot of the amplitude control wheel and supported on the other end of said spring member and engageable into the groove of the frequency control wheel of the corresponding frequency modulation control device being mounted on the corresponding amplitude control wheel for enabling the corresponding frequency control wheel to be synchronously rotated with the corresponding amplitude control wheel.

* * * * *